US005870662A

United States Patent [19]

Tomatsu

[11] Patent Number: 5,870,662

[45] Date of Patent: Feb. 9, 1999

[54] ANTI-CURL FEATURE IN A FIXING DEVICE FOR AN IMAGE FORMING APPARATUS

[75] Inventor: Yoshiya Tomatsu, Kasugai, Japan

[73] Assignee: Brother Kogyo Kabushiki Kaisha, Nagoya, Japan

[21] Appl. No.: 28,000

[22] Filed: Feb. 23, 1998

[30] Foreign Application Priority Data

Feb. 28, 1997 [JP] Japan ..... 9-045388

[51] Int. Cl.[6] ..... G03G 15/20

[52] U.S. Cl. ..... 399/406; 399/330

[58] Field of Search ..... 399/406, 320, 399/321, 322, 328, 330; 271/161, 188, 209

[56] References Cited

U.S. PATENT DOCUMENTS 4,652,110 3/1987 Sato et al. .
5,187,527 2/1993 Forlani et al. .
5,258,815 11/1993 Nakagawa et al. .
5,565,971 10/1996 Kuo et al. .

FOREIGN PATENT DOCUMENTS

A-9-319201 12/1997 Japan .

*Primary Examiner*—Richard Moses
*Attorney, Agent, or Firm*—Oliff & Berridge, PLC

[57] ABSTRACT

Curl caused in a paper sheet in a fixing device during fixing of a toner image is removed while smoothly changing a direction of feed of the paper toward a plurality of paired discharge rollers in the fixing device. Anti-curl ribs, each having a rounded face that projects to pass through a plane connecting a contact point between a heating roller and a pressing roller and a contact point between the respective discharge rollers are arranged between the heating roller and the pressing roller and the plurality of paired discharge rollers in a fixing unit. Further, a first set of paired discharge rollers and a fourth set of paired discharge rollers are arranged respectively in correspondence with the anti-curl ribs and two of the anti-curl ribs are provided in correspondence with the side portions of the paper. Lastly, bent guide films are arranged on both sides of second guide ribs that correspond to the first and fourth sets of paired discharge rollers to facilitate paper feed.

31 Claims, 4 Drawing Sheets

ANTI-CURL FEATURE IN A FIXING DEVICE FOR AN IMAGE FORMING APPARATUS

BACKGROUND OF THE INVENTION

1. Field of Invention

The invention relates to a fixing device in an image forming apparatus for fixing a toner image transcribed on paper by heating paper on which an image formed by supplying a toner in accordance with an electrostatic latent image formed on a photosensitive drum in a developing device, is transcribed. Particularly, the invention relates to a fixing device capable of removing curl caused in the paper in the fixing device in fixing a toner image by smoothly changing a feed direction of the paper toward a discharge roller in a fixing device.

2. Description of Related Art

There have conventionally been proposed various image forming devices, such as a laser printer or the like, adopting a so-called electronic photographing system. For example, an image forming device having a paper feeding device, a laser scanning device, a toner supplying device, a developing device, a fixing device and the like in gross classification, is disclosed in the specification and the drawings of Japanese Printed Patent Document No. 9-319201. According to such an image forming device, an electrostatic latent image is formed on the surface of a photosensitive drum in the developing device in accordance with image data provided by the laser scanning device, a toner image is formed on the photosensitive drum by supplying a toner in accordance with the electrostatic latent image from the toner supplying device, the toner image is transcribed by the cooperation of a transcribing roller and the photosensitive drum on a paper transferred from the paper feeding device into the developing device and thereafter, the toner image is fixed by heating the paper by the fixing device.

According to the fixing device, paper is heated by a heating roller in fixing the toner image. As a result, curl is caused in the paper after fixing processing and therefore, various curl removing means are provided to remove the curl caused in the paper. According to the curl removing means, generally, a method of removing curl is by winding the paper in a direction reverse to the direction of curl, caused during fixing, has been adopted.

For example, it is a general method that in a fixing device, a discharge roller and a pressing roller that is brought into press contact with the heating roller are arranged on the downstream side of a heating roller in the paper feed direction, two auxiliary casters are brought into press contact with the discharge roller, and a reverse curl is provided to the paper on the basis of cooperation between the discharge roller and the respective auxiliary casters thereby removing the curl of the paper.

However, according to the conventional fixing device, in structuring the means for removing curl from the paper, the two auxiliary casters which are brought into press contact with the discharge roller are needed and further, accessory parts, such as a spring, for bringing the respective auxiliary casters into press contact with the discharge roller are also needed. As a result, the cost of the fixing device is increased and the total cost of the image forming apparatus is increased.

SUMMARY OF THE INVENTION

The invention resolves the problems. It is an object of the invention to provide a fixing device capable of removing curl caused in the paper by the fixing device while smoothly changing a direction of feed of the paper to discharge rollers in the fixing device.

In order to achieve the above-described object, according to a first aspect of the invention, there is provided a fixing device of an image forming apparatus for forming a toner image on paper and fixing the toner image by heating the toner image, the fixing device including a pair of rotatable fixing rollers for heating and fixing, a pair of discharge rollers provided rotatably on a downstream side of the pair of fixing rollers in a direction of transfer of the paper for discharging the paper, and curl removing pieces arranged to project so as to pass through a plane connecting a contact point between the pair of fixing rollers and a contact point between the pair of discharge rollers for removing curl caused in the paper which has passed through the pair of fixing rollers.

According to the fixing device of the first aspect of the invention, in fixing the toner image formed on the paper, the paper is fed into the fixing device and the toner image is heated and fixed by the pair of fixing rollers. After heating and fixing the toner image, the paper is fed to outside of the fixing device via the pair of discharge rollers. In this case, the curl removing pieces, arranged to project so as to pass through the plane connecting the contact points between the pair of fixing rollers and the pair of discharge rollers, are provided between the pair of fixing rollers and the pair of discharge rollers and therefore, the paper is directed by the curl removing pieces whereby the curl, caused in the paper during the heating and fixing of the toner image by the pair of fixing rollers, can be removed by the curl removing pieces. In this way, according to the first aspect of the fixing device, the curl caused in the paper can be removed by arranging the curl removing pieces without the necessity of auxiliary casters or the like and the cost of the fixing device can be reduced.

Further, according to a second aspect of the invention, there is provided the fixing device of an image forming apparatus in accordance with the first aspect wherein at least two sets of the pairs of discharge rollers are provided and the curl removing pieces are provided respectively in correspondence with the respective pairs of discharge rollers. According to the second aspect of the fixing device, the curl removing pieces are provided in correspondence with the respective sets of the pairs of discharge rollers and accordingly, tension can efficiently be applied to the paper by the respective curl removing pieces and the pairs of discharge rollers whereby the curl of the paper can efficiently be removed.

Further, according to a third aspect of the invention, there is provided the fixing device of an image forming apparatus in accordance with the second aspect wherein the curl removing pieces are provided respectively in correspondence with both side portions in a width direction of the paper. According to the third aspect of the fixing device, the respective curl removing pieces are provided in correspondence with the side portions in the width direction of the paper and, accordingly, the paper can be discharged to outside of the fixing device while efficiently removing the curl caused at the side portions of the paper.

Further, according to a fourth aspect of the invention, there is provided the fixing device of an image forming apparatus in accordance with any one of the first through the third aspects wherein the pair of fixing rollers comprise a heating roller for heating the paper and a pressing roller which is brought into contact with the heating roller and the curl removing pieces are arranged from a side of the pressing roller to project so as to pass through the plane.

According to the fourth aspect of the fixing device, similar to the case of the first aspect of the invention, in fixing the toner image formed on the paper, the paper is fed into the fixing device and the toner image is heated and fixed by the heating roller and the pressing roller. After heating and fixing the toner image, the paper is fed outside of the fixing device via the pair of discharge rollers. In this case, the curl removing pieces are arranged to project from the side of the pressing roller to pass through the plane connecting the contact points between the heating roller and the pressing roller and between the pair of discharge rollers and, therefore, the paper is directed by the curl removing pieces by which the curl caused at the paper in heating and fixing the toner image is removed by the curl removing pieces.

Further, according to a fifth aspect of the invention, there is provided the fixing device of an image forming apparatus in accordance with any one of the first through the fourth aspects wherein a rounded, or curved, face is provided at a portion of each of the curl removing pieces opposed to the pair of fixing rollers. According to the fifth aspect of the fixing device, the rounded faces are provided at portions of the curl removing pieces opposed to the pair of fixing rollers and therefore, the lead edge portion of the paper fed from the pair of fixing rollers is guided by the rounded faces and the curl is removed reasonably while smoothly changing the direction of feed of the paper toward the discharge rollers.

Further, according to a sixth aspect of the fixing device, there is provided the fixing device of an image forming apparatus in accordance with any one of the first through the fifth aspects wherein the curl removing piece is a curl removing rib formed at an inner face of a cover covering at least one of the pair of pressing rollers and the pair of discharge rollers. According to the sixth aspect of the fixing device, the curl removing ribs are formed on the inner face of the cover covering at least one of the pair of pressing rollers and the pair of discharge rollers. Therefore, the cost of the image forming apparatus can be reduced since the curl removing ribs are formed integrally with the cover.

Further, according to a seventh aspect of the invention, there is provided the fixing device of an image forming apparatus in accordance with any one of the first through the sixth aspects wherein a plurality of guide pieces for guiding the lead edge of the paper to the pair of discharge rollers are provided in opposition to the curl removing pieces. Guide films, in a bent shape, are provided positioned among the guide pieces and at positions opposite to the curl removing pieces. According to the seventh aspect of the fixing device, the guide films in a bent form are provided at positions opposite to the curl removing pieces and accordingly, the lead edge of the paper, after the heating and fixing operation, can be guided to the pair of discharge rollers smoothly via the respective guide pieces and the guide films.

BRIEF DESCRIPTION OF THE DRAWINGS

A preferred embodiment of the invention will be described in detail with reference to the following figures wherein.

DETAILED DESCRIPTION OF PREFERRED EMBODIMENTS

Figure 1:
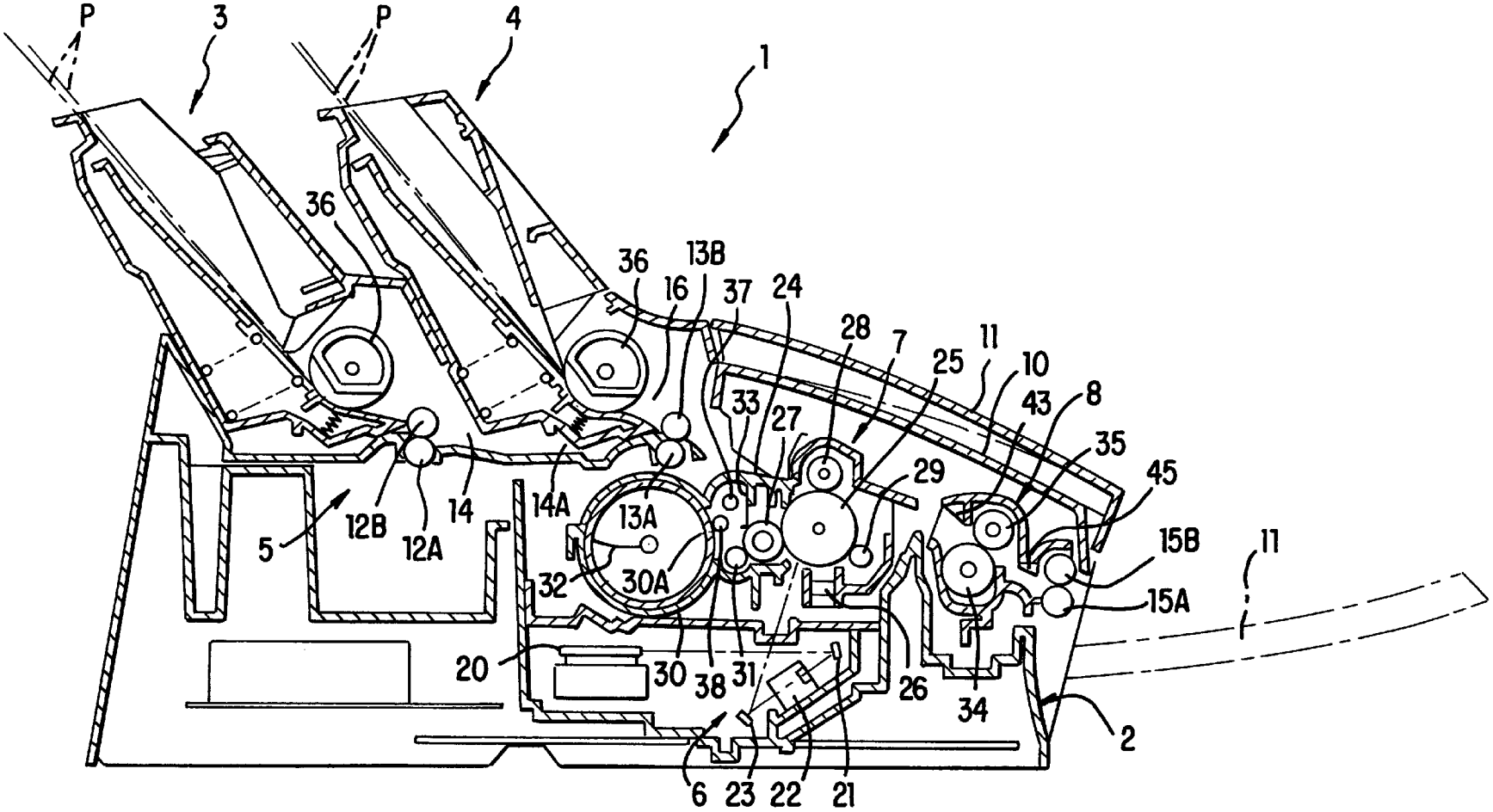
FIG. 1 is a side sectional view of a laser printer.

A detailed explanation will be given of a fixing device of an image forming apparatus according to the invention based on embodiments implementing the invention in exemplary use with a laser printer in reference to the drawings. Firstly, an explanation will be given of an outline structure of the laser printer using the invention with reference to FIG. 1. FIG. 1 is a side sectional view of a laser printer.

In FIG. 1, a laser printer 1 includes a main body case 2, a first paper, or other print medium, feed tray 3 installed on the rear upper face side of the main body 2, a second paper feed tray 4, a paper feed mechanism 5 installed in the main body case 2, a scanner unit 6, a processing unit 7, a fixing unit 8, a drive unit (not illustrated; incorporated in a left end side portion of the main body case 2) for driving the paper feed mechanism 5 for the respective first and second paper feed trays 3 and 4 and the like, and so on. A top cover 10 which can open the upper face side of a print mechanism portion and a paper discharge tray 11 are found on the front upper face side of the main body case 2. The paper discharge tray 11 can be switched between a closed position and an open position and functions as a tray for receiving printed paper, or other print medium, at the open position.

In this embodiment, the scanner unit 6, the processing unit 7, and the fixing unit 8 correspond to the print mechanism portion. The processing unit 7 is provided with a cartridge structure incorporating a photosensitive drum 25, an electrifier 26, a developing roller 27, a transcribing roller 28, and a cleaning roller 29 in a casing 24. The casing 24 is attachable and detachable to and from a predetermined portion of the inside of the main body case 2.

The first paper feed tray 3 is fixedly provided at the upper, rear portion of the main body case 2 and the second paper feed tray 4 is installed attachably and detachably to and from the upper face portion, to the front of the first feed paper tray 3, of the main body case 2. The paper feed mechanism 5 is installed for feeding paper P selectively from the first paper feed tray 3 and the second paper feed tray 4 to the processing unit 7 and includes a pair of feed rollers 12A, 12B installed on the lower end side of the first paper feed tray 3 and a pair of resist rollers 13A, 13B installed on the lower end side of the second paper feed tray 4. The feed roller 12A is a driving roller and the feed roller 12B is a following roller. The resist roller 13A is a driving roller and the resist roller 13B is a following roller. A paper feed path 14 extending from the first paper feed tray 3 to the resist rollers 13A, 13B includes a lower face side feed path 14A extending along the lower face of the second paper feed tray 4 and the lower face side feed path 14A is open to outside when the second paper feed tray 4 is removed from the main body case 2.

The paper P, fed from first paper feed tray 3 via a pickup roller 36, reaches the resist rollers 13A, 13B via the lower face side feed path 14A after being fed by the pair of feed rollers 12A, 12B and is fed to the processing unit 7 by the resist rollers 13A, 13B. The paper P fed from the second paper feed tray 4 via the pickup roller 36 reaches the resist rollers 13A, 13B and is fed to the processing unit 7.

The scanner unit 6 is arranged on the lower side of the processing unit 7 and is provided with a semiconductor laser (not illustrated), a polygonal mirror 20, reflecting mirrors 21, 23 and a lens 22. An electrostatic latent image is formed on the surface of the photosensitive drum 25 by irradiating and exposing, by a high-speed scanning of a laser beam from the semiconductor laser, an outer peripheral portion of the electrified rotating photosensitive drum 25 of the processing unit 7 via the polygonal mirror 20, the reflecting mirror 21, the lens 22, and the reflecting mirror 23 as shown by the chain line.

The processing unit 7 incorporates the photosensitive drum 25, the scorotron type electrifier 26, the developing roller 27, the transcribing roller 28, the cleaning roller 29, a toner box 30, and a toner supply roller 31 in the casing 24. The toner can be replenished to the toner box 30 when the processing unit 7 is removed from the main body case 2. The toner in the toner box 30 is stirred by a stirrer 32, discharged from an opening 30A of the toner box 30 and, thereafter, supplied to the developing roller 27 via the toner supply roller 31, and then carried by the developing roller 27 as a toner layer. The toner layer has a constant thickness provided by a blade 33 and is supplied to the photosensitive drum 25. Further, two auger members 37, 38 are rotatably arranged at positions at vicinity of the opening 30A of the toner box 30 and the respective auger members 37, 38 operate to uniformly disperse the toner discharged from the opening 30A in the casing 24.

The electrostatic latent image formed on the surface of the photosensitive drum 25 adheres the toner from the developing roller 27. The toner image is then transferred onto the paper P (it is to be understood that paper P represents a sheet recording medium used in a printing apparatus) when the paper P passes between the photosensitive drum 25 and the transcribing roller 28 and the paper P is then fed into the fixing unit 8 and the image is fixed. Incidentally, toner remaining on the surface of the photosensitive drum 25 is temporarily recovered by the cleaning roller 29 and is recovered by the developing roller 27 via the photosensitive drum 25 at predetermined timings. The fixing unit 8 thermally fixes the toner on the paper P and is provided with a heating roller 34, a pressing roller 35 which is brought into press contact with the heating roller 34, and a pair of discharge rollers 15A, 15B provided on the downstream side of the respective rollers 34, 35 for discharging the paper P to the outside of the main body case 2.

Further, a feed speed at which the paper P is fed by the photosensitive drum 25 and the transcribing roller 28 of the processing unit 7 is set to be equal to or greater than a feed speed at which the paper P is fed by the heating roller 34, the pressing roller 35 and the respective discharge rollers 15A, 15B of the fixing unit 8. When the feed speed at which the paper P is fed by the heating roller 34, the pressing roller 36 and the respective discharge rollers 15A, 15B is larger than the feed speed at which the paper P is fed by the photosensitive drum 25 and the transcribing roller 28, there is a concern that the paper P will be pulled at a point where the toner image is transferred from the photosensitive drum 25 onto the paper P, that is, at a nip point between the photosensitive drum 25 and the transcribing roller 28 whereby the position at which the image is formed on the paper P is shifted and the image is disturbed.

Figure 2:
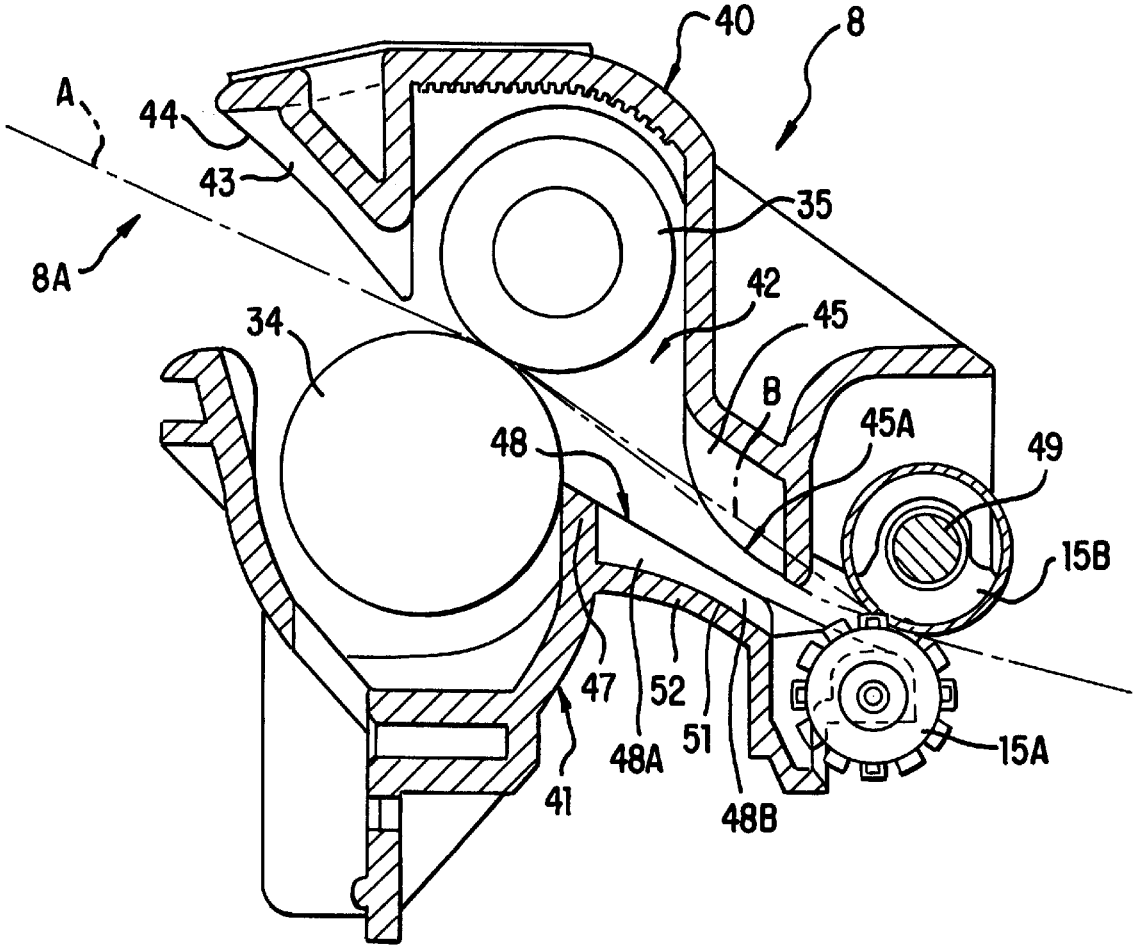
FIG. 2 is a side sectional view, on an enlarged scale, of a fixing unit.

Next, an explanation will be given of the detailed structure of the fixing unit 8 with reference to FIG. 2. FIG. 2 is a enlarged side sectional view of the fixing unit 8.

The fixing unit 8 is provided with an upper cover 40 and a lower cover 41 and a fixing chamber 42 is formed between the upper cover 40 and the lower cover 41, respectively. The heating roller 34 is rotatably arranged at a lower portion and the pressing roller 35 is rotatably arranged at an upper portion, while being pressed against the heating roller 34, of the fixing chamber 42.

On the upstream side of the fixing chamber 42, at the upper end portion (left end portion in FIG. 2) of the upper cover 40, a plurality of guide ribs 43 are formed. The guide ribs 43 are arrayed along the longitudinal axes of the heating roller 35, pressing roller 34 tandem, and aligned in a direction parallel to a feed path A (indicated by two-dotted chain line) of the paper P. The guide ribs 43 smoothly guide the paper P fed from a paper feed inlet 8A, from the processing unit 7, to the fixing chamber 42. In order to facilitate the guiding operation, inclined faces 44 are gradually inclined toward the feed path A. The lead edge of the paper P contacts the inclined faces 44 of the guide ribs 43 and, thereafter, is fed to a nip point between the pressing roller 35 and the heating roller 34 by being guided in the lower direction along the inclined faces 44.

Further, an anti-curl rib 45 is formed to extend from the inner, upper wall of the upper cover 40 on the downstream side of the pressing roller 35 and the heating roller 34. The anti-curl rib 45 removes the curl produced in the paper P when the toner image on the paper P is heated and fixed by the cooperation of the heating roller 34 and the pressing roller 35. The pair of discharge rollers 15A, 15B for discharging the heated and fixed paper P are rotatably arranged on the downstream side of the fixing chamber 42.

Here, the anti-curl rib 45 is formed to project from an inner, upper wall of the upper cover 40 to pass through a plane B (indicated by one-dotted chain line) connecting a contact point of, or nip between, the heating roller 34 and the pressing roller 35 and a contact point of, or nip between, the respective discharge rollers 15A, 15B. The lower end of the anti-curl rib 45 is arranged on the lower side of the plane B and operates to direct the paper P downwardly. As a result, the anti-curl rib 45 removes the curl caused in the paper P in heating and fixing the paper P by the heating roller 34 and the pressing roller 35. Further, the anti-curl rib 45 is provided with a rounded, or curved, face 45A at a portion thereof opposed to the heating roller 34 and the pressing roller 35. The rounded face 45A operates to guide the lead edge of the paper P fed from the heating roller 34 and the pressing roller 35 toward the lower side and removes the curl while changing the direction of feed of the paper P toward the respective discharge rollers 15A, 15B.

Figure 3:
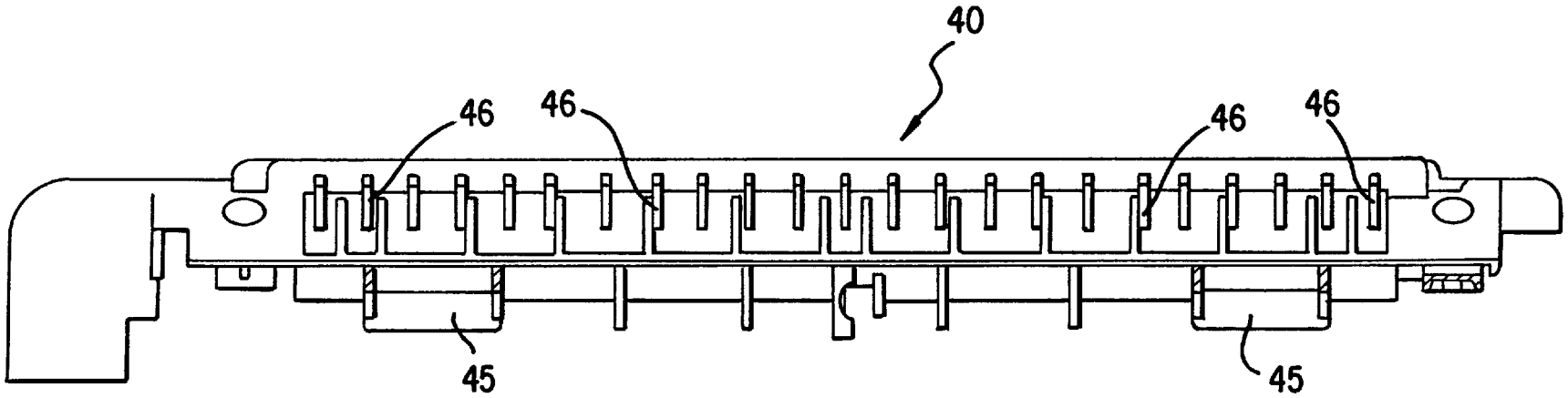
FIG. 3 is a back view of an upper cover.

Further, as shown by FIG. 3, two of the anti-curl ribs 45 are formed at both of the side portions of the upper cover 40 along the width direction of the upper cover 40 (left and right direction in FIG. 3). Therefore, the anti-curl ribs 45 are installed in correspondence with the side portions in the width direction of the paper P. By arranging the anti-curl ribs 45 in such a manner, in correspondence with the side portions in the width direction of the paper P, the curl caused at the side portions of the paper P can efficiently be removed. Further, a plurality of steam discharge holes 46 are formed in the upper cover 40 on the upper side of the respective anti-curl ribs 45. The respective steam discharge holes 46 are holes for discharging steam generated, in heating and fixing a toner image on the paper P via the heating roller 34 and the pressing roller 35, from moisture absorbed in the paper P to outside the image forming apparatus.

Further, a wall portion 47 is formed in the lower cover 41 on the downstream side of the heating roller 34 at a position proximate to the heating roller 34 face. A plurality of guide ribs 48 are integrally formed with the wall portion 47 and oriented toward the downstream side of the feed path A. In this case, as the respective guide ribs 48, there are first guide ribs 48A that extend to positions proximate to the lower side discharge roller 15A and second guide ribs 48B which are shorter than the first guide ribs 48A.

Figure 4:
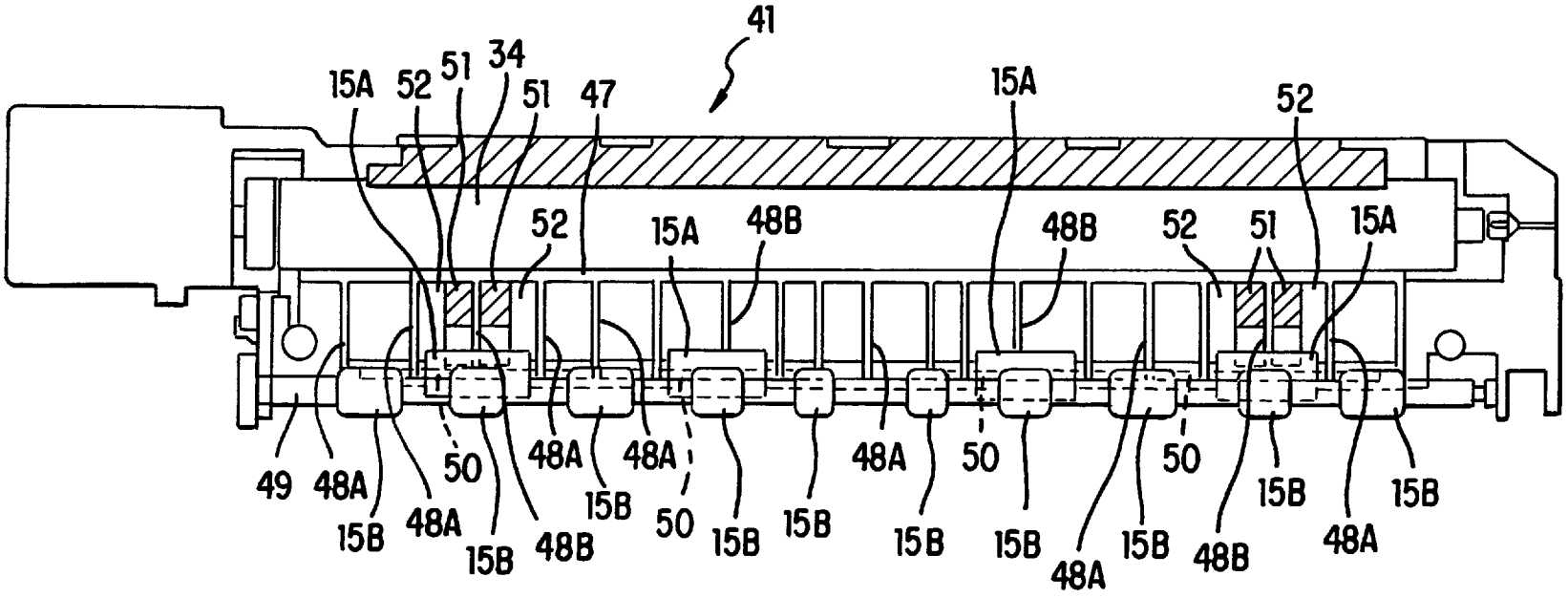
FIG. 4 is a plane view of a lower cover shown by removing the upper cover of the fixing unit.

An explanation of the arrangement of the first guide ribs 48A and the second guide ribs 48B and a relationship between the guide ribs 48A, 48B and the respective discharge rollers 15A, 15B will be given with reference to FIG. 4. FIG. 4 is a plan view of the lower cover 41 shown by removing the upper cover 40 of the fixing unit 8.

Among the plurality of guide ribs 48, four of the second guide ribs 48B are provided at substantially equal intervals on the downstream side (lower side in FIG. 4) of the lower cover 41 and a plurality the first guide ribs 48A are arranged at the sides of and between the respective second guide ribs 48B. Further, a plurality (10 in the embodiment) of the upper side discharge rollers 15B are installed on a roller shaft 49 and a second, a fourth, a seventh and a ninth from left of the discharge rollers 15B among the respective discharge rollers 15B are brought into press contact with the four of the lower side discharge rollers 15A. Incidentally, the respective discharge rollers 15A are supported rotatably by a roller shaft 50. The roller shaft 50 is formed from coil springs which provide the necessary pressing force and they facilitate assembly.

In this case, a set of the second discharge roller 15B and a discharge roller 15A and a set of the ninth discharge roller 15B and a discharge roller 15A are arranged respectively in correspondence with the anti-curl ribs 45 (alternatively defined as the first and fourth sets of paired discharge rollers) (refer to FIG. 3). Because the anti-curl ribs 45 are installed in correspondence with the respective sets of the discharge rollers 15B, 15A, tension is applied to the paper P by the respective anti-curl ribs 45 and the respective sets of the discharge rollers 15B, 15A so that the curl of the paper P is efficiently removed.

Further, the above-described sets of the second, the fourth, the seventh and the ninth discharge rollers 15B and opposing discharge rollers 15A are arranged in correspondence with the respective four second guide ribs 48B. Guide films 51, in a bent form, are arranged at both sides of the second guide ribs 48B that are associated with the set of the second discharge roller 15B and discharge roller 15A and the set of the ninth discharge roller 15B and the discharge roller 15A. Each of the guide films 51 is mounted on the upper face of a bottom wall 52 in the lower cover 41 between the guide ribs 48 and a front end portion thereof is brought into contact with the roller face of the discharge roller 15A (refer to FIG. 2). In such a structure, on a side opposed to the anti-curl ribs 45 is the guide film 51 in a bent form at positions corresponding and opposite to the anti-curl ribs 45. Therefore, the lead edge of the paper P, after the heating and fixing operation, is smoothly guided to the respective discharge rollers 15A, 15B via the respective first and second guide ribs 48A, 48B and the guide films 51.

As has been explained in detail, according to the laser printer 1 of this embodiment, the anti-curl ribs 45 are arranged to project so as to cross the plane B connecting the contact point between the heating roller 34 and the pressing roller 35 and the contact point between the respective discharge rollers 15A, 15B and are provided between the heating roller 34 and the pressing roller 35 and the discharge rollers 15A, 15B. Therefore, the paper P is directed by the anti-curl ribs 45. Thus, the curl created in the paper P in heating and fixing a toner image by the heating roller 34 and the pressing roller 35 can be removed by the anti-curl ribs 45. In this way, according to the fixing unit 8 of the embodiment, auxiliary casters or the like are not needed for removing the curl as in the conventional case, the curl caused at the paper P can be removed by arranging the anti-curl ribs 45 at the inner upper wall of the upper cover 40 and the cost of the fixing unit 8 is reduced.

Further, the set of the second discharge roller 15B, a discharge roller 15A and the set of the ninth discharge roller 15B and a discharge roller 15A, are arranged respectively aligned with the anti-curl ribs 45. Therefore, tension can efficiently be provided to the paper P by the anti-curl ribs 45 and the respective sets of the discharge rollers 15B, 15A by which the curl in the paper P can efficiently be removed.

Further, two of the respective anti-curl ribs 45 are installed in correspondence with the side portions in the width direction of the paper P. Accordingly, the paper can be discharged outside of the fixing unit 8 while efficiently removing the curl caused at the side portions of the paper P.

Further, each of the anti-curl ribs 45 is provided with the rounded face 45A at a portion opposed to the heating roller 34 and the pressing roller 35. Such a rounded face 45A operates to guide the lead edge of the paper P, fed from the heating roller 34 and the pressing roller 35, downwardly. Accordingly, the curl can be removed reasonably while smoothly changing the direction of feed of the paper P toward the respective discharge rollers 15A, 15B along the feed path A.

Further, the respective anti-curl ribs 45 extend from the inner upper wall of the upper cover 40 integrally with the upper cover 40 and therefore, the cost of the fixing unit 8 can be reduced.

Further, the bent guide films 51 are arranged at both sides of the second guide ribs 48B in correspondence with the set of the second discharge roller 15B and discharge roller 15A and the set of the ninth discharge roller 15B and discharge roller 15A. The respective guide films 51 are mounted on the upper face of the bottom wall 52 in the lower cover 41 and the lead edge of the paper P is brought into contact with the roller faces of the discharge rollers 15B. Further, the guide films 51 are located at positions opposite the anti-curl ribs 45. Therefore, the lead edge of the paper P, after the heating and fixing operation, can be guided to the respective discharge rollers 15A, 15B by the respective first and second guide ribs 48A, 48B and the guide films 51.

Incidentally, the invention is not limited to the above-described embodiments but various improvements and modifications can naturally be carried out within the scope of the invention.

What is claimed is:

1. A fixing device of an image forming apparatus for forming a toner image on a print medium and fixing the toner image by heating the toner image, the fixing device comprising:

a pair of opposed, rotatable fixing rollers for heating and fixing;

a pair of opposed, discharge rollers provided rotatably on a downstream side of said pair of fixing rollers in a direction of transporting the print medium for discharging said print medium; and curl removing pieces arranged to project to pass through a plane connecting a contact point between the pair of fixing rollers and a contact point between the pair of discharge rollers for removing curl caused in the print medium which has been fixed by the pair of fixing rollers.

2. The fixing device of an image forming apparatus according to claim 1, wherein at least two sets of the pairs of discharge rollers are provided and the curl removing pieces are provided to correspond with the respective pairs of discharge rollers.

3. The fixing device of an image forming apparatus according to claim 2, wherein the curl removing pieces are provided respectively in correspondence with both side portions in a width direction of the print medium.

4. The fixing device of an image forming apparatus according to claim 1, wherein the pair of fixing rollers comprise a heating roller for heating the print medium and a pressing roller which is brought into press contact with the heating roller and the curl removing pieces are arranged from a side of the pressing roller to project through the plane.

5. The fixing device of an image forming apparatus according to claim 1, wherein a rounded face is provided at a portion of each of the curl removing pieces opposed to the pair of fixing rollers.

6. The fixing device of an image forming apparatus according to claim 1, wherein the curl removing piece is a curl removing rib formed at an inner surface of a cover covering at least one of the pair of pressing rollers and the pair of discharge rollers.

7. The fixing device of an image forming apparatus according to claim 1, wherein a plurality of guide pieces for guiding lead edge of the print medium to the pair of discharge rollers are provided opposed to the curl removing pieces, and guide films in a bent shape are provided among the guide pieces and at positions in opposition to the curl removing pieces.

8. The fixing device of an image forming apparatus according to claim 2, wherein the pair of fixing rollers comprise a heating roller for heating the print medium and a pressing roller which is brought into press contact with the heating roller and the curl removing pieces are arranged from a side of the pressing roller to project through the plane.

9. The fixing device of an image forming apparatus according to claim 3, wherein the pair of fixing rollers comprise a heating roller for heating the paper and a pressing roller which is brought into press contact with the heating roller and the curl removing pieces are arranged from a side of the pressing roller to project through the plane.

10. The fixing device of an image forming apparatus according to claim 2, wherein a rounded face is provided at a portion of each of the curl removing pieces opposed to the pair of fixing rollers.

11. The fixing device of an image forming apparatus according to claim 3, wherein a rounded face is provided at a portion of each of the curl removing pieces opposed to the pair of fixing rollers.

12. The fixing device of an image forming apparatus according to claim 4, wherein a rounded face is provided at a portion of each of the curl removing pieces opposed to the pair of fixing rollers.

13. The fixing device of an image forming apparatus according to claim 2, wherein the curl removing piece is a curl removing rib formed at an inner surface of a cover covering at least one of the pair of pressing rollers and the pair of discharge rollers.

14. The fixing device of an image forming apparatus according to claim 3, wherein the curl removing piece is a curl removing rib formed at an inner surface of a cover covering at least one of the pair of pressing rollers and the pair of discharge rollers.

15. The fixing device of an image forming apparatus according to claim 4, wherein the curl removing piece is a curl removing rib formed at an inner surface of a cover covering at least one of the pair of pressing rollers and the pair of discharge rollers.

16. The fixing device of an image forming apparatus according to claim 5, wherein the curl removing piece is a curl removing rib formed at an inner surface of a cover covering at least one of the pair of pressing rollers and the pair of discharge rollers.

17. The fixing device of an image forming apparatus according to claim 2, wherein a plurality of guide pieces for guiding lead edge of the print medium to the pair of discharge rollers are provided opposed to the curl removing pieces, and guide films in a bent shape are provided among the guide pieces and at positions in opposition to the curl removing pieces.

18. The fixing device of an image forming apparatus according to claim 3, wherein a plurality of guide pieces for guiding lead edge of the print medium to the pair of discharge rollers are provided opposed to the curl removing pieces, and guide films in a bent shape are provided among the guide pieces and at positions in opposition to the curl removing pieces.

19. The fixing device of an image forming apparatus according to claim 4, wherein a plurality of guide pieces for guiding lead edge of the print medium to the pair of discharge rollers are provided opposed to the curl removing pieces, and guide films in a bent shape are provided among the guide pieces and at positions in opposition to the curl removing pieces.

20. The fixing device of an image forming apparatus according to claim 5, wherein a plurality of guide pieces for guiding lead edge of the print medium to the pair of discharge rollers are provided opposed to the curl removing pieces, and guide films in a bent shape are provided among the guide pieces and at positions in opposition to the curl removing pieces.

21. The fixing device of an image forming apparatus according to claim 6, wherein a plurality of guide pieces for guiding lead edge of the print medium to the pair of discharge rollers are provided opposed to the curl removing pieces, and guide films in a bent shape are provided among the guide pieces and at positions in opposition to the curl removing pieces.

22. An anti-curl device for a printing apparatus, comprising:

a first wall;

a second wall, the first wall and the second wall defining a fixing chamber therebetween;

a heating roller rotatably mounted in the heating chamber;

a pressing roller rotatably mounted in the heating chamber and in pressing contact with the heating roller to define a nip at the contact;

a plurality of discharge rollers rotatably mounted downstream, relative to a print medium direction of movement, of the pressing roller and the heating roller, at least one set of paired discharge rollers defining a discharge nip where the at least one set of paired discharge rollers are in contact; and a plurality of anti-curl ribs extending from the first wall into the heating chamber downstream from the pressing roller, at least an upstream end of each anti-curl rib passing through an imaginary plane extending between the nip of the heating roller and the pressing roller and the discharge nip of the at least one set of paired discharge rollers.

23. The anti-curl device according to claim 22, wherein the upstream end of each of the anti-curl ribs has a concave curved shape.

24. The anti-curl device according to claim 22, wherein at least one anti-curl rib is provided to correspond to and oppose each side edge of a print medium passing through the printing apparatus.

25. The anti-curl device according to claim 22, wherein a pair of anti-curl ribs is provided to correspond to and oppose each side edge of a print medium passing through the printing apparatus.

26. The anti-curl device according to claim 24, wherein a set of paired discharge rollers is associated with the at least one anti-curl rib provided to correspond to each side edge of the print medium.

27. The anti-curl device according to claim 22, wherein the at least one set of paired discharge rollers comprises at least two sets of paired discharge rollers, one set at each side of a print medium feed path through the printing apparatus.

28. The anti-curl device according to claim 22, further comprising a plurality of guide members extending from the second wall into the fixing chamber, the plurality of guide members downstream of the heating roller.

29. The anti-curl device according to claim 28, wherein the plurality of guide members comprise a first set of guide members and a second set of guide members.

30. The anti-curl device according to claim 29, wherein a guide member of the first set of guide members is aligned along a print medium feed path with each set of paired discharge rollers.

31. The anti-curl device according to claim 29, wherein the guide members of the first set of guide members have a different length along a print medium feed path than the guide members of the second set of guide members.

* * * * *